US005173570A

United States Patent [19]

Braun

[11] Patent Number: 5,173,570

[45] Date of Patent: Dec. 22, 1992

[54] DETONATOR IGNITION CIRCUITRY

[75] Inventor: Christopher G. Braun, Neptune, N.J.

[73] Assignee: The United States of America as represented by the Secretary of the Army, Washington, D.C.

[21] Appl. No.: 910,858

[22] Filed: Jul. 8, 1992

[51] Int. Cl.[5] ..... F42B 3/10; F42B 4/14

[52] U.S. Cl. ..... 102/347; 102/352; 102/202.7

[58] Field of Search ..... 102/347, 382, 202.7

[56] References Cited

U.S. PATENT DOCUMENTS

| | | | |
|---|---|---|---|
| 3,981,241 | 9/1976 | Ambrosini et al. | 102/32 |
| 4,729,319 | 3/1988 | Orlando | 102/351 |
| 4,762,067 | 8/1988 | Barker et al. | 102/313 |
| 4,840,122 | 6/1989 | Nerheim | 102/202.7 X |
| 4,924,774 | 5/1990 | Lenzen | 102/202.7 X |
| 5,022,326 | 6/1991 | Silvia | 102/202.7 X |
| 5,052,301 | 10/1991 | Walker | 102/202.7 |

*Primary Examiner*—Peter A. Nelson

*Attorney, Agent, or Firm*—Michael Zelenka; John M. O'Meara

[57] ABSTRACT

In detonator ignition circuitry, reliability is enhanced by significantly increasing the ignition energy voltage. Application of the high voltage ignition energy to the detonator is accomplished through a breakdown device which passes the ignition energy to the detonator only when the voltage thereof reaches its conductive threshold. To avoid the complications of high voltage design in the preferred embodiments, the ignition energy is stored at less than that threshold voltage and is boosted thereto when detonator ignition is desired.

6 Claims, 1 Drawing Sheet

DETONATOR IGNITION CIRCUITRY

GOVERNMENT INTEREST

The invention described herein may be manufactured, used, and licensed by or for the government for governmental purposes without payment to me of any royalties thereon.

BACKGROUND OF THE INVENTION

The present invention relates generally to circuitry for igniting detonators and more particularly, to such circuitry which directs capacitance stored energy to an exploding-bridge-wire detonator in response to a trigger signal.

Detonators of the exploding-bridge-wire type are ignited by directing electric energy therethrough. Circuitry for directing this energy to such detonators is well known in the art, as evidenced by U.S. Pat. No. 4,934,268 which issued on Jun. 19, 1990 to Don M. Levin. With such circuitry, detonator ignition reliability increases as the energy voltage is increased. When, a gate controlled electronic switch is utilized in such circuitry for directing the energy to the detonator, the quality thereof must be enhanced as the energy voltage is increased. Of course, enhanced switch quality always means higher cost.

SUMMARY OF THE INVENTION

It is the general object of the present invention to improve the reliability of detonator ignition circuitry without substantially increasing the cost thereof.

It is a specific object of the present invention to accomplish the above stated general object by storing the ignition energy in capacitance and boosting the voltage thereof to a conductive threshold when detonator ignition is desired.

These and other objects are accomplished in accordance with the present invention by conducting the stored ignition energy to the detonator through a breakdown device having a voltage threshold to which the ignition energy voltage is boosted. In the preferred embodiments, a trigger signal initiates detonator ignition by causing the energy storing capacitance to be discharged through an inductance, which thereby boosts the energy voltage to that conductive threshold. For a particular embodiment, capacitance and inductance values are selected to substantially invert the energy voltage and thereby effect a doubling thereof. When utilized in missile warhead applications, the circuitry of the invention also includes a gate controlled electronic switch which is triggered by a target arrival signal and functions to discharge the capacitance.

The scope of the present invention is only limited by the appended claims for which support is predicated on the preferred embodiments hereafter set forth in the following description and the attached drawings wherein like reference characters relate to like parts throughout the several figures.

DESCRIPTION OF THE PREFERRED EMBODIMENTS

Figure 1:
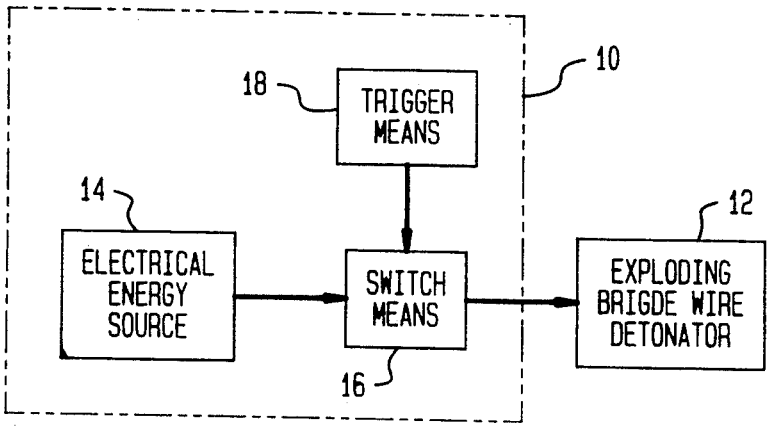
FIG. 1 is a block diagram of the circuitry typically utilized to ignite an exploding-bridge-wire detonator.

As shown in FIG. 1, circuitry 10 for igniting an exploding-bridge-wire detonator 12 conventionally includes a source 14 of sufficient electrical energy to ignite the detonator 12, a switch means 16 for applying the electrical energy to the detonator 12, and a trigger means 18 for actuating the switch means 16 when the detonator 12 is to be ignited. Of course, the sophistication of circuitry 10 depends on the requirements of the application in which the detonator 12 is utilized. Low energy detonators are utilized for many blasting applications such as mining, for which circuitry 10 may include a battery as the electrical energy source 14 and a mechanically actuated switch as both the switch means 16 and the trigger means 18. High energy detonators are utilized for more sophisticated applications such as missile warheads, for which circuitry 10 may include charged capacitance as the electrical energy source 14, while an electronic switch and a target arrival switch respectively, are included as the switch means 16 and in the trigger means 18. The present invention relates to the latter type applications and enhances detonator ignition reliability without appreciable cost increase. As shown in the detonator ignition circuitry 10' of FIG. 2, a breakdown means 20 for conducting electrical energy therethrough when the voltage thereacross reaches a threshold is incorporated in the invention, along with a means 22 for boosting the voltage of capacitance stored energy to the threshold magnitude of the breakdown means 20 when a trigger signal is applied.

Detonator ignition circuitry 10' illustrates the preferred embodiments of the present invention. Such circuitry is for utilization in a missile warhead however, its preferred embodiments have many other applications such as in mining or demolition activities. Detonator ignition reliability is enhanced in all embodiments of the present invention by selecting the breakdown means 20 to provide a very high threshold, such as 1000 volts minimum. In circuitry 10', the breakdown means 20 is an arc discharge switch or surge arrester, such as those manufactured by C. P. Clare Corporation of 3101-T W. Pratt Ave., Chicago, IL 60645. However, any device through which conduction occurs due to breakdown at the desired voltage threshold could be utilized for the breakdown means 20, such as a zener diode or an SCR connected only across its anode and cathode terminals. Of course, the switch means 16 in FIG. 1 could be selected to control the ignition energy at very high voltage, but the cost thereof would be prohibitive relative to that of the breakdown means 20.

Within the circuitry 10' generally, the energy source 14' includes capacitance which stores the ignition energy at some voltage below the threshold of the breakdown means 20. However, for the missile warhead embodiment of FIG. 2 specifically, capacitors C1 and C2 are series connected in the energy source 14' between ground and one terminal of the breakdown means 20 which has the other terminal thereof connected to ground through the detonator 12'. A high impedance, such as a resistor R1, is connected from ground to the node between C1 and the breakdown means 20, at which the ignition energy is stored by charging the node between C1 and C2 to a DC voltage V1, which for the FIG. 2 embodiment is negative.

Figure 2:
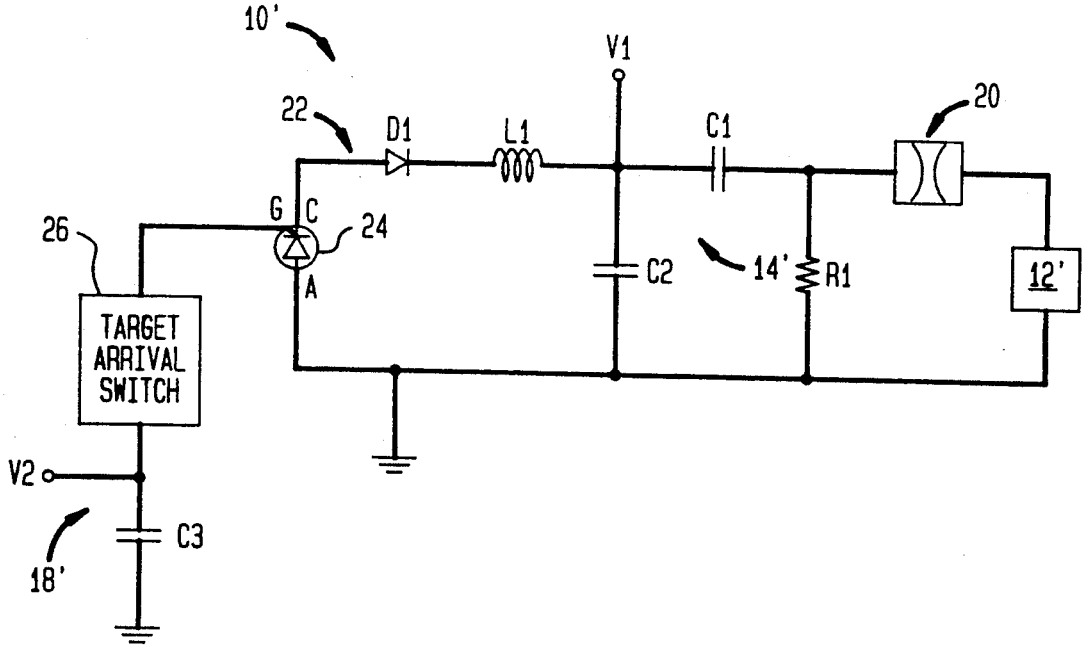
FIG. 2 is a schematic drawing of detonator ignition circuitry in accordance with the present invention.

In the FIG. 2 implementation of the voltage boosting means 22, inductance is included through which the capacitance in the energy source 14' is discharged to effectively increase the voltage of the ignition energy. Although only a single inductor L1 is utilized in the FIG. 2 embodiment, such inductance could be a plurality of inductors in other embodiments and could even be disposed in an electromagnetic device, such as a transformer or an autotransformer. L1 is connected to derive the voltage boost by grounding the node between C1 and C2 to ground through an electronic switch 24, in response to the trigger signal. Of course, electronic switch 24 includes a gate or control terminal G, such as is found on a SCR (Silicon Controlled Rectifier) or a MCT (MOS Controlled Thyristor). A trigger means 18' for applying a signal at terminal G to render switch 24 conductive, includes at least one capacitor C3 having one side thereof connected to terminal G through the normally open contact (not specifically shown) of a target arrival switch 26 and the other side thereof connected to ground. The node between switch 26 and C3 is charged to a DC voltage V2, which for the FIG. 2 embodiment is negative. Various types of switch 26 could be utilized, such as the crush type which actuates upon impact with the target, or the proximity type which actuates when the missile passes within a predetermined distance from the target.

Prior to actuation of the target arrival switch 26, the negative charge level at the node between C1 and C2 sustains a voltage which must be withstood across the electronic switch 24. Consequently, as this negative charge level is increased, the quality and expense of electronic switch 24 must also be increased. The node between C1 and the breakdown means 20 is held at or near ground by R1 during the charging process and before the triggering of switch 24. Also, the voltage threshold of the breakdown means 20 is typically selected to be greater than the V1 charge voltage but not greater than the increased ignition energy voltage which is derived due to the boosting means 22. By design therefore, before the ignition energy voltage, is boosted, it cannot actuate the breakdown means 20.

When switch 26 is actuated to close the normally open contacts thereof, the negative charge level on C3 is applied therethrough to terminal G of switch 24, as the trigger signal. This renders switch 24 conductive and discharges the node between C1 and C2 through L1 to ground. Because voltage change across L1 leads current change therethrough, the polarity at the node between C1 and C2 is changed from negative to positive. This change causes the voltage at the node between C1 and the breakdown means 20 to go from near zero to twice the charge voltage V1 which increases the absolute value of the ignition energy voltage thereat relative to the threshold of the breakdown means 20. By design, this increase raises the ignition energy voltage to at least the threshold of the breakdown means 20 which then becomes conductive to pass the ignition energy through the detonator 12' to ground. A diode D1 is disposed in the circuitry 10' of FIG. 2, which prevents a decrease of the ignition energy voltage at the node between C1 and the breakdown means 20 due to ringing therein after the trigger signal is applied.

The values of C1, C2, L1 and V1 are selected in accordance with conventional circuit theory to accomplish the desired ignition energy voltage increase. Furthermore, these values may be selected to effectively double the ignition energy voltage by substantially inverting the voltage at the node between C1 and C2. Because voltage change lags current change relative to the capacitance, L1 must be sized to accomplish the desired voltage lead characteristic, while overcoming the lag conditions caused by C1 and C2. Of course, the size of C1, C2, and V1 must be in accordance with the previously discussed charge levels which are stored at the nodes prior to actuation of the target arrival switch 28.

Those skilled in the art will appreciate without any further explanation that within the concept of this invention many modifications and variations are possible to the above disclosed embodiments of detonator ignition circuitry. Consequently, it should be understood that all such modifications and variations fall within the scope of the following claims.

What I claim is:

1. In detonator ignition circuitry of the type wherein capacitance stored electric energy is applied to an exploding-bridge-wire detonator in response to a trigger signal, the improvement comprising:

the energy passes to the detonator through a breakdown means for conducting electricity therethrough when voltage thereacross reaches a threshold; and means for boosting the energy voltage to the threshold of said breakdown means when the trigger signal is applied.

2. The circuitry of claim 1 wherein said breakdown means is an arc discharge switch.

3. The circuitry of claim 1 wherein said voltage boosting means includes inductance through which the capacitance is discharged to change the polarity of the energy voltage.

4. In missile warhead detonator ignition circuitry of the type wherein electric energy is stored in capacitance and applied to an exploding-bridge-wire detonator by actuating a gate controlled electronic switch, the improvement comprising:

the energy passes to the detonator through a breakdown means for conducting electricity therethrough when voltage thereacross reaches a threshold; and means for boosting the energy voltage to the threshold of said breakdown means when the electronic switch is actuated.

5. The circuitry of claim 4 wherein said breakdown means is an arc discharge switch.

6. The circuitry of claim 4 wherein said voltage boosting means includes inductance through which the capacitance is discharged to change the polarity of the energy voltage.

* * * * *